US009109829B2

(12) United States Patent
Lim et al.

(10) Patent No.: US 9,109,829 B2
(45) Date of Patent: Aug. 18, 2015

(54) CONTROL METHOD OF REFRIGERATOR

(75) Inventors: Chang Hak Lim, Hwaseong-si (KR); Keon Ho Hong, Suwon-si (KR); Young Shik Shin, Seongnam-si (KR); Jae Koog An, Gwangiu (KR); Jin Jeong, Yongin-si (KR); Sang Hyun Park, Seongnam-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 880 days.

(21) Appl. No.: 12/926,262

(22) Filed: Nov. 4, 2010

(65) Prior Publication Data

US 2011/0162392 A1 Jul. 7, 2011

(30) Foreign Application Priority Data

Jan. 4, 2010 (KR) ..... 10-2010-0000277

(51) Int. Cl.

*F25C 5/00* (2006.01)
*F25C 5/02* (2006.01)
*F25D 29/00* (2006.01)

(52) U.S. Cl.

CPC ..... *F25D 29/00* (2013.01); *F25C 2600/04* (2013.01); *F25D 2317/061* (2013.01); *F25D 2317/0682* (2013.01); *F25D 2700/121* (2013.01); *F25D 2700/123* (2013.01)

(58) Field of Classification Search

CPC ..... F25C 2700/12; F25C 5/08; F25D 11/02; F25D 17/065
USPC ..... 62/66, 71, 140, 150–153, 155–156, 62/234, 236, DIG. 9, 340, 344, 419, 459
See application file for complete search history.

(56) References Cited

U.S. PATENT DOCUMENTS 3,864,933 A * 2/1975 Bright ..... 62/137
5,769,541 A * 6/1998 Lee et al. ..... 374/141

(Continued)

FOREIGN PATENT DOCUMENTS

CN 101133293 A 2/2008
CN 101287954 A 10/2008

(Continued)

OTHER PUBLICATIONS

Chinese Office Action issued Mar. 5, 2014 in corresponding Chinese Application No. 201010579614.1.

*Primary Examiner* — Ljiljana Ciric
*Assistant Examiner* — Alexis Cox
(74) *Attorney, Agent, or Firm* — Staas & Halsey LLP

(57) ABSTRACT

A control method of a refrigerator to prevent frost from being formed in an ice making chamber. The refrigerator includes an ice making chamber refrigerant pipe to supply a refrigerant to make ice in a direct cooling manner and an ice making chamber circulation fan to create a forced air stream to circulate air in the ice making chamber. The control method includes determining whether temperature of the ice making chamber is lower than a predetermined temperature and driving the ice making chamber circulation fan in a state in which the temperature of the ice making chamber is lower than the predetermined temperature and the refrigerant flows in the ice making chamber refrigerant pipe or when flow of the refrigerant in the ice making chamber refrigerant pipe is interrupted in a state in which the temperature of the ice making chamber is lower than the predetermined temperature.

14 Claims, 10 Drawing Sheets

(56) References Cited

U.S. PATENT DOCUMENTS

| | | | | |
|---|---|---|---|---|
| 6,725,680 | B1 * | 4/2004 | Schenk et al. | 62/186 |
| 6,895,767 | B2 * | 5/2005 | Hu | 62/135 |
| 7,942,014 | B2 * | 5/2011 | Rafalovich et al. | 62/155 |
| 8,099,968 | B2 * | 1/2012 | Watson et al. | 62/66 |
| 8,534,087 | B2 * | 9/2013 | Lee et al. | 62/345 |
| 8,616,018 | B2 * | 12/2013 | Jeong et al. | 62/340 |
| 2006/0086130 | A1 * | 4/2006 | Anselmino et al. | 62/344 |
| 2006/0266056 | A1 * | 11/2006 | Chang | 62/135 |
| 2008/0156026 | A1 * | 7/2008 | Shin et al. | 62/353 |
| 2008/0209937 | A1 * | 9/2008 | Wu et al. | 62/340 |
| 2010/0122543 | A1 * | 5/2010 | Lee et al. | 62/71 |
| 2010/0218519 | A1 * | 9/2010 | Hall et al. | 62/73 |
| 2013/0239594 | A1 * | 9/2013 | Lin et al. | 62/73 |

FOREIGN PATENT DOCUMENTS

| | | |
|---|---|---|
| JP | 2-195169 | 8/1990 |
| JP | 3-213979 | 9/1991 |
| JP | 11-223444 | 8/1999 |
| KR | 10-2006-0076863 | 7/2006 |

* cited by examiner

CONTROL METHOD OF REFRIGERATOR

CROSS-REFERENCE TO RELATED APPLICATIONS

This application claims the benefit of Korean Patent Application No. 2010-0000277, filed on Jan. 4, 2010 in the Korean Intellectual Property Office, the disclosure of which is incorporated herein by reference.

BACKGROUND

1. Field

Embodiments relate to a control method of a refrigerator to prevent frost formation.

2. Description of the Related Art

A refrigerator lowers interior temperature of a storage chamber to store food at low temperature for a long period of time in a fresh state through a refrigeration cycle in which a refrigerant is compressed, condensed, expanded and evaporated. The refrigerator basically includes a compressor to compress a low-temperature and low-pressure gas refrigerant into a high-temperature and high-pressure gas refrigerant, a condenser to condense the refrigerant discharged from the compressor through heat exchange between the refrigerant and air outside the refrigerator, a capillary tube to decompress the refrigerant condensed by the condenser, and an evaporator to evaporate the refrigerant decompressed by the capillary tube to absorb heat from the storage chamber through heat exchange between the refrigerant and air in the storage chamber.

The refrigerator may include an ice making unit including a tray to receive water to make ice and an ice storage container to store the ice. The ice making unit may be classified as an indirect cooling type ice making unit in which cool air is supplied to cool the tray using a forced air stream to freeze water into ice or a direct cooling type ice making unit in which a refrigerant pipe directly contacts the tray or water to freeze water into ice.

In the direct cooling type ice making unit, an ice making mechanism is relatively simple, and cooling speed is very high; however, temperature difference between the ice making unit and air in an ice making chamber is large, with the result that frost may be easily formed.

SUMMARY

Therefore, it is an aspect to provide a control method of a refrigerator to prevent frost from being formed in an ice making chamber.

Additional aspects will be set forth in part in the description which follows and, in part, will be apparent from the description, or may be learned by practice of the invention.

In accordance with one aspect, a control method of a refrigerator including an ice making chamber having an ice making tray, an ice making chamber refrigerant pipe to supply cool air to the ice making tray, and an ice making chamber circulation fan to circulate air in the ice making chamber includes determining whether temperature of the ice making chamber is lower than a predetermined temperature and driving the ice making chamber circulation fan to prevent frost from being formed in the ice making chamber upon determining that the temperature of the ice making chamber is lower than the predetermined temperature.

Driving the ice making chamber circulation fan to prevent frost from being formed in the ice making chamber may include driving the ice making chamber circulation fan for a predetermined period of time when the temperature of the ice making chamber is lower than the predetermined temperature.

Driving the ice making chamber circulation fan to prevent frost from being formed in the ice making chamber may include driving the ice making chamber circulation fan until temperature of the ice making tray is equal to the temperature of the air in the ice making chamber.

The refrigerator may further include a drain duct of an inclined structure disposed below the ice making tray, and the control method may further include driving the ice making chamber circulation fan until temperature of the drain duct is equal to the temperature of the air in the ice making chamber.

The control method may further include driving the ice making chamber circulation fan at a low mode in a state in which the temperature of the ice making chamber is lower than the predetermined temperature and a refrigerant flows in the ice making chamber refrigerant pipe.

The control method may further include driving the ice making chamber circulation fan at a high mode when flow of a refrigerant in the ice making chamber refrigerant pipe is interrupted in a state in which the temperature of the ice making chamber is lower than the predetermined temperature.

The control method may further include driving the ice making chamber circulation fan at a low mode in a state in which the temperature of the ice making chamber is lower than the predetermined temperature and the ice making chamber is not full of ice.

In accordance with another aspect, a control method of a refrigerator including an ice making chamber having an ice making tray, an ice making chamber refrigerant pipe to supply cool air to the ice making tray, and an ice making chamber circulation fan to circulate air in the ice making chamber includes determining whether temperature of the ice making chamber is lower than a predetermined temperature, determining whether a refrigerant flows in the ice making chamber refrigerant pipe, and variably driving the ice making chamber circulation fan based on the temperature of the ice making chamber and determination as to whether the refrigerant flows in the ice making chamber refrigerant pipe.

The control method may further include driving the ice making chamber circulation fan at a low mode in a state in which the temperature of the ice making chamber is lower than the predetermined temperature and the refrigerant flows in the ice making chamber refrigerant pipe.

The control method may further include driving the ice making chamber circulation fan at a high mode in a state in which the temperature of the ice making chamber is lower than the predetermined temperature and the refrigerant does not flow in the ice making chamber refrigerant pipe.

Driving the ice making chamber circulation fan may include driving the ice making chamber circulation fan for a predetermined period of time when the temperature of the ice making chamber is lower than the predetermined temperature.

Driving the ice making chamber circulation fan may include driving the ice making chamber circulation fan until temperature of the ice making tray is equal to the temperature of the air in the ice making chamber.

The refrigerator may further include a drain duct of an inclined structure disposed below the ice making tray, and the control method may further include driving the ice making chamber circulation fan until temperature of the drain duct is equal to the temperature of the air in the ice making chamber.

In accordance with a further aspect, a control method of a refrigerator including an ice making chamber, an ice making unit disposed in the ice making chamber, and an ice making chamber circulation fan to circulate air in the ice making chamber includes determining whether temperature of the ice making chamber is lower than a predetermined temperature, determining whether the temperature of the ice making chamber is equal to temperature of the ice making unit when the temperature of the ice making chamber is lower than the predetermined temperature, and stopping the ice making chamber circulation fan upon determining that the temperature of the ice making chamber is equal to the temperature of the ice making unit.

The ice making unit may include an ice making tray, and detecting the temperature of the ice making unit may include detecting temperature of the ice making tray.

The ice making unit may further include a drain duct provided below the ice making tray, and detecting the temperature of the ice making unit may include detecting temperature of the drain duct.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
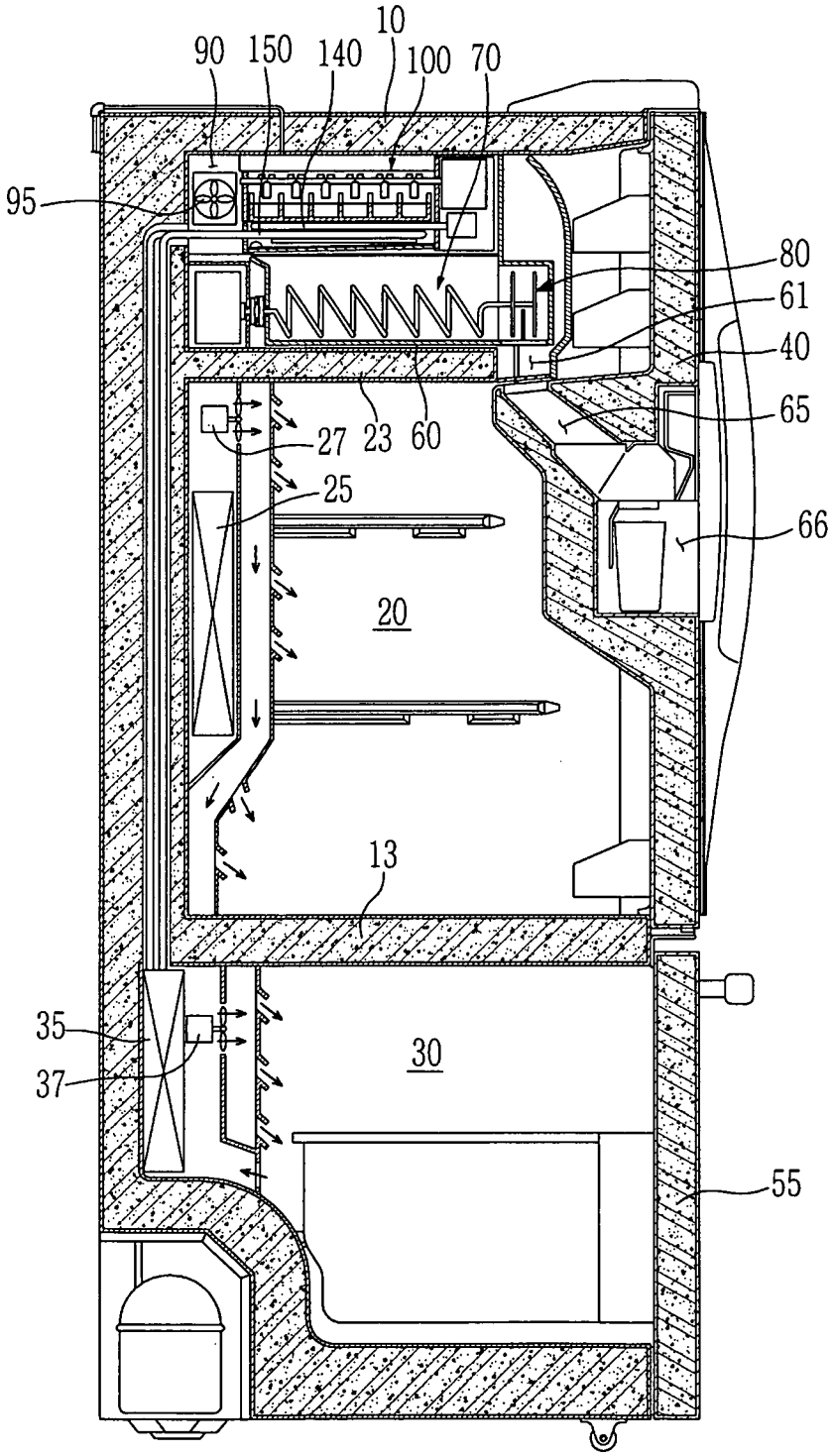
FIG. 1 is a sectional view illustrating a refrigerator including an ice making chamber according to an embodiment.

Reference will now be made in detail to the embodiments, examples of which are illustrated in the accompanying drawings, wherein like reference numerals refer to like elements throughout.

Figure 2:
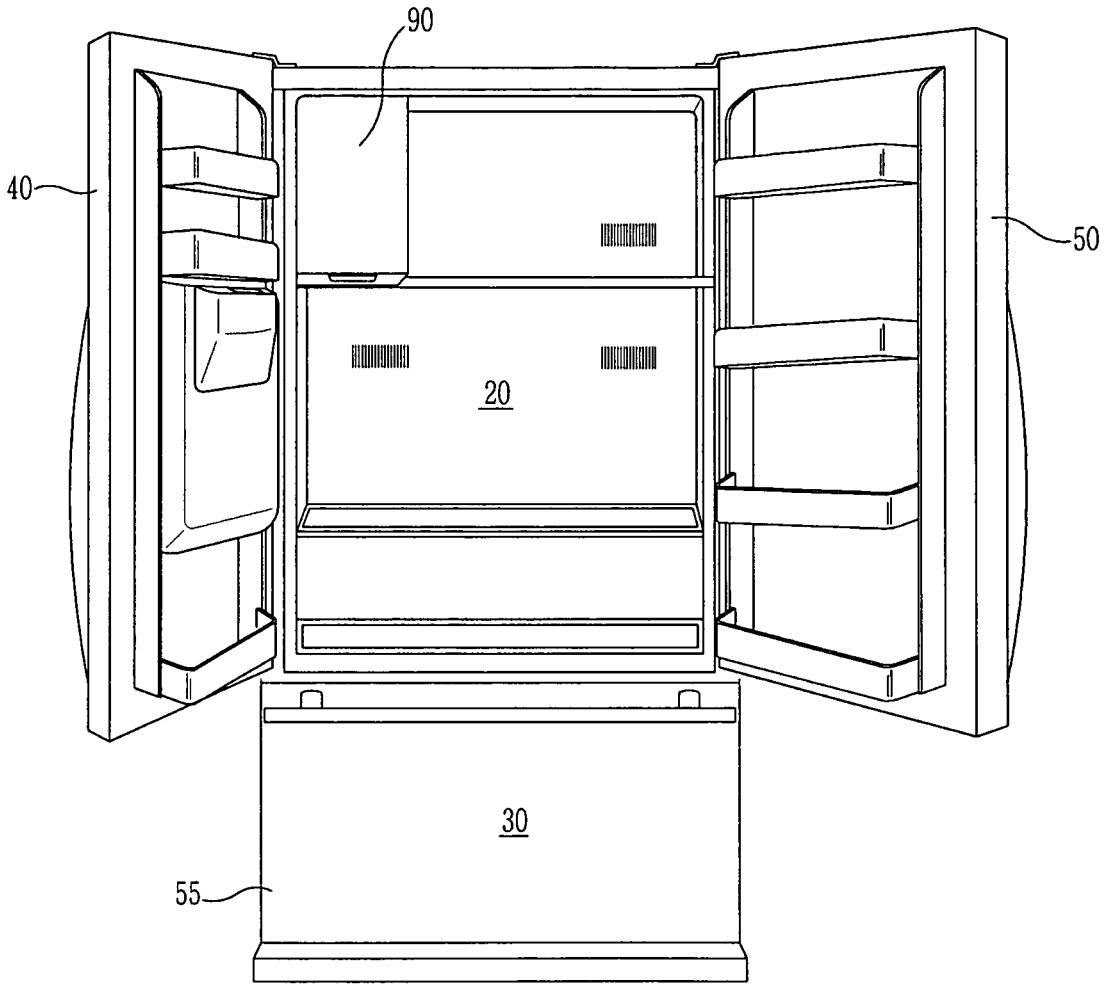
FIG. 2 is a front view of the refrigerator including the ice making chamber according to the embodiment.

FIG. 1 is a sectional view illustrating a refrigerator including an ice making chamber according to an embodiment, and FIG. 2 is a front view of the refrigerator including the ice making chamber according to the embodiment.

As shown in FIGS. 1 and 2, the refrigerator includes a refrigerator body 10 having an upper refrigerating chamber 20 and a lower freezing chamber 30 partitioned by a partition wall 13.

The refrigerating chamber 20 and the freezing chamber 30 are opened at the fronts thereof. The upper refrigerating chamber 20 is opened and closed by a first refrigerating chamber door 40 and a second refrigerating chamber door 50. The lower freezing chamber 30 is opened and closed by a freezing chamber door 55. The first refrigerating chamber door 40 and the second refrigerating chamber door 50 are hingedly coupled to opposite sides of the refrigerator body 10 such that the first refrigerating chamber door 40 and a second refrigerating chamber door 50 are opened and closed by side to side hinged rotation thereof. The freezing chamber door 55 is coupled to the refrigerator body 10 such that the freezing chamber door 55 is opened and closed by frontward and rearward movement thereof.

At the inside rear of the refrigerating chamber 20 are mounted a refrigerating chamber evaporator 25 to cool the refrigerating chamber 20 and a refrigerating chamber circulation fan 27 to circulate cool air in the refrigerating chamber 20.

At the inside rear of the freezing chamber 30 are mounted a freezing chamber evaporator 35 to cool the freezing chamber 30 and a freezing chamber circulation fan 37 to circulate cool air in the freezing chamber 30.

At an upper corner of the refrigerating chamber 20 is mounted an ice making chamber 90 partitioned from the internal space of the refrigerating chamber 20 by an insulation wall 23.

At the rear of the ice making chamber 90 are provided an ice making chamber circulation fan 95 to circulate air in the ice making chamber 90 and an ice making chamber refrigerant pipe 150 connected to the refrigerating chamber evaporator 25 or the freezing chamber evaporator 35. When the temperature of the ice making chamber 90 is higher than a predetermined temperature, the ice making chamber circulation fan 95 turns on. On the other hand, when the temperature of the ice making chamber 90 is lower than the predetermined temperature, the ice making chamber circulation fan 95 turns off. A refrigerant circulated by a refrigeration cycle flows in the ice making chamber refrigerant pipe 150.

Above the ice making chamber 90 is provided a water supply pipe (not shown) to supply water to the ice making chamber 90.

In the ice making chamber 90 are provided an ice making unit 100 to make ice, an ice storage container 60 to store the ice made by the ice making unit 100, the ice storage container 60 having an ice discharge port 61 formed at one side thereof, an ice transfer device 70 to discharge the ice, and an ice crushing device 80 to crush and discharge the ice discharged through the ice discharge port 61 as needed.

The first refrigerating chamber door 40 has a discharge chute 65 to guide the ice discharged through the ice discharge port 61 of the ice storage container 60 to the outside of the first refrigerating chamber door 40. At the front of the first refrigerating chamber door 40 is provided an ice receiving space 66 to receive the ice discharged through the discharge chute 65.

Figure 3A:
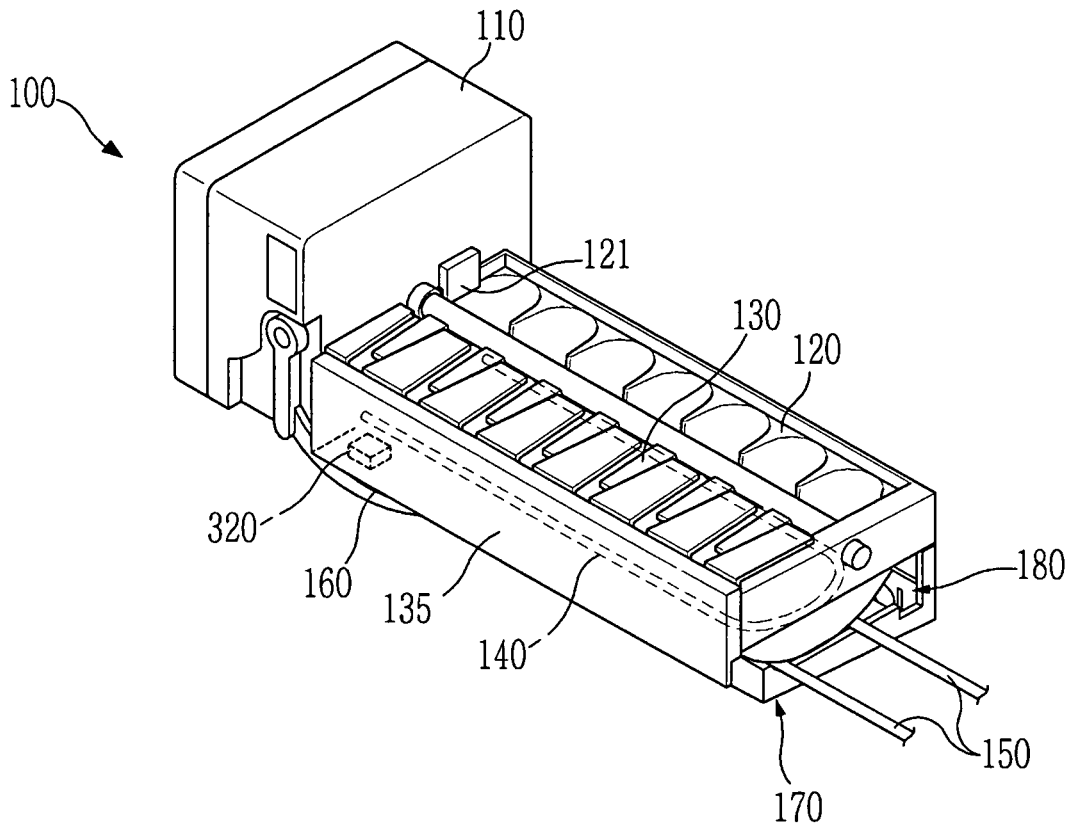
FIG. 3A is a perspective view illustrating an ice making unit according to an embodiment.
Figure 3B:
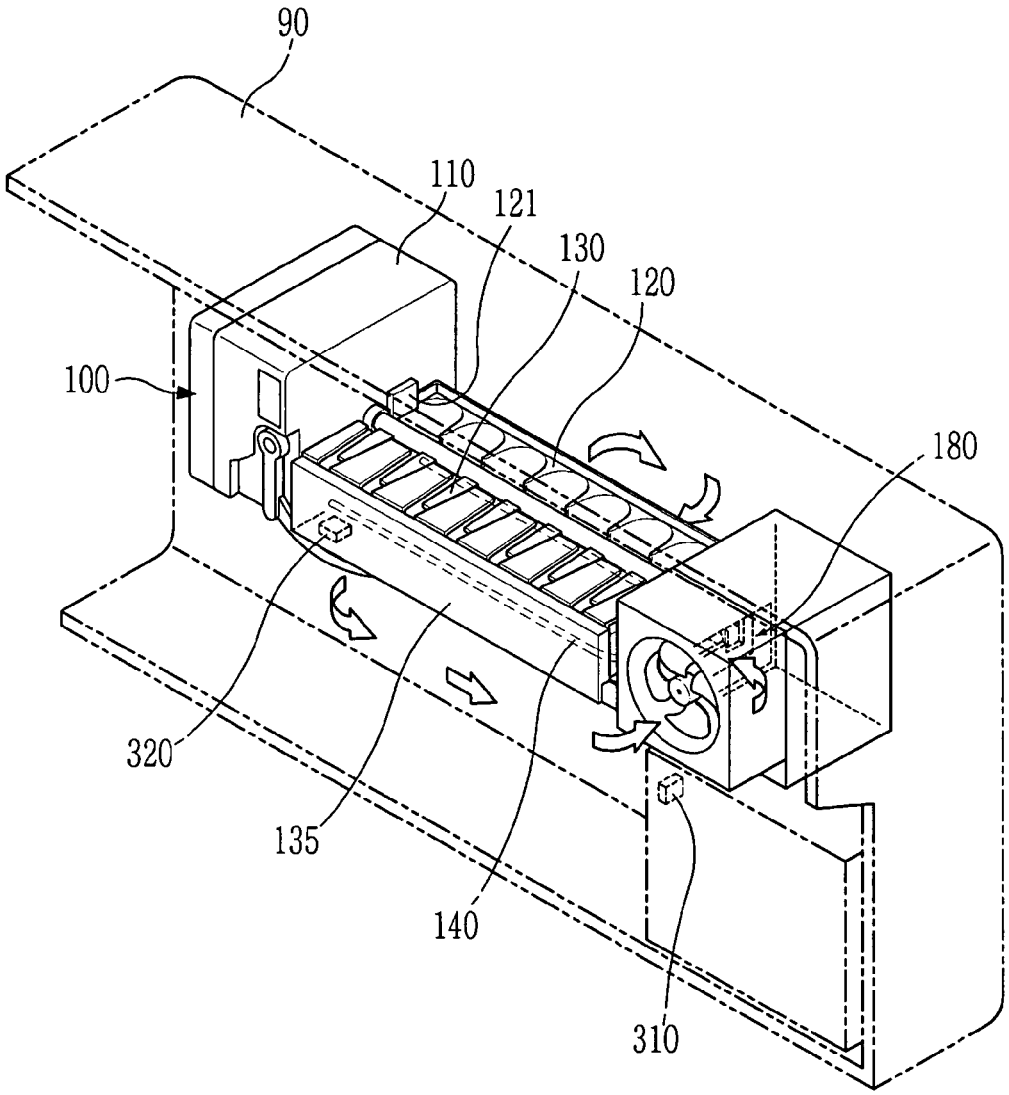
FIG. 3B is a view illustrating a direction in which an air stream flows in the ice making chamber according to the embodiment of the present invention upon driving a circulating fan of the ice making chamber.

FIG. 3A is a perspective view illustrating an ice making unit according to an embodiment, and FIG. 3B is a view illustrating a direction in which an air stream flows in the ice making chamber according to the embodiment upon driving a circulating fan of the ice making chamber.

As shown in FIG. 3A, the ice making unit 100 includes an electronic component compartment 110 in which various electronic components are disposed, an ice making tray 120 disposed at one side of the electronic component compartment 110, an ice making unit temperature sensor 121 mounted between the electronic component compartment 110 and the ice making tray 120 to measure temperature of ice and the ice making tray 120, an ice separation heater 140 disposed below the ice making tray 120 to heat the ice making tray 120, an ice making chamber refrigerant pipe 150 disposed below the ice making tray 120 such that the ice making chamber refrigerant pipe 150 does not overlap with the ice separation heater 140, a drain duct 170 disposed below the ice making tray 120 and the ice making chamber refrigerant pipe 150, and another ice making unit temperature sensor 320 to measure temperature of the drain duct 170.

Various electronic components are disposed in the electronic component compartment 110.

The ice making tray 120 is a space to receive water supplied through the water supply pipe (not shown) to make ice. Above the ice making tray 120 is mounted an ice separation member 130 to separate ice from the ice making tray 120. The ice separation member 130 is rotatably coupled to the electronic component compartment 110. The ice separation member 130 is rotated by a motor mounted in the electronic component compartment 110 to separate ice from the ice making tray 120. An ice separation member guide 135 is mounted at one side of the ice separation member 130 to prevent overflow of water from the ice making tray 120 and to assist smooth discharge of ice.

A full ice lever 160 is mounted between the ice making tray 120 and the ice separation member guide 135. The full ice lever 160 detects a full ice state of the ice storage container 60.

The ice separation heater 140 and the ice making chamber refrigerant pipe 150 are disposed below the ice making tray 120. The ice separation heater 140 and the ice making chamber refrigerant pipe 150 are disposed such that the ice separation heater 140 and the ice making chamber refrigerant pipe 150 overlap each other. Also, the ice separation heater 140 and the ice making chamber refrigerant pipe 150 are in direct contact with the ice making tray 120.

During separation of ice made in the ice making tray 120, the ice separation heater 140, to which power from the electronic component compartment 110 is supplied, heats the ice making tray 120 to achieve easy separation of the ice.

The ice making chamber refrigerant pipe 150 contacts the bottom of the ice making tray 120 to directly transmit cool air to the ice making tray 120 such that ice is made in the ice making tray 120.

The drain duct 170 is disposed below the ice making tray 120 and the ice making chamber refrigerant pipe 150 to collect and drain defrost water created in the vicinity of the ice making tray 120 and the ice making chamber refrigerant pipe 150.

The ice making unit temperature sensor 121 is mounted between the electronic component compartment 110 and the ice making tray 120 to measure the temperature of ice and the ice making tray 120. Also, the ice making unit temperature sensor 320 is mounted in the drain duct 170 to measure the temperature of the drain duct 170, which is used as control information of the ice making chamber circulation fan 95. In FIG. 3A, two ice making unit temperature sensors are adopted. Alternatively, only one ice making unit temperature sensor may be adopted, and temperature measured by the ice making unit temperature sensor may be used as control information of the ice making chamber circulation fan 95.

The ice making unit 100 is disposed in the ice making chamber 90. The ice making chamber circulation fan 95 is provided at the rear of the ice making unit 100 to circulate air in the ice making chamber 90 to maintain the entire ice making chamber 90 at low temperature. As shown in FIG. 3B, air discharged from the ice making chamber circulation fan 95 passes through a space 180 between the ice making tray 120 and the drain duct 170, with the result that cool air from the ice making chamber refrigerant pipe 150 is uniformly diffused throughout the ice making chamber 90. While the ice making chamber circulation fan 95 is driven, therefore, easy circulation of air in the ice making chamber 90 is achieved, and therefore, the entire ice making chamber 90 is uniformly maintained at low temperature, thereby preventing frost from being formed in the ice making chamber 90.

Hereinafter, formation of frost in the ice making chamber 90 in an ice making cycle will be described in detail.

Figure 4A:
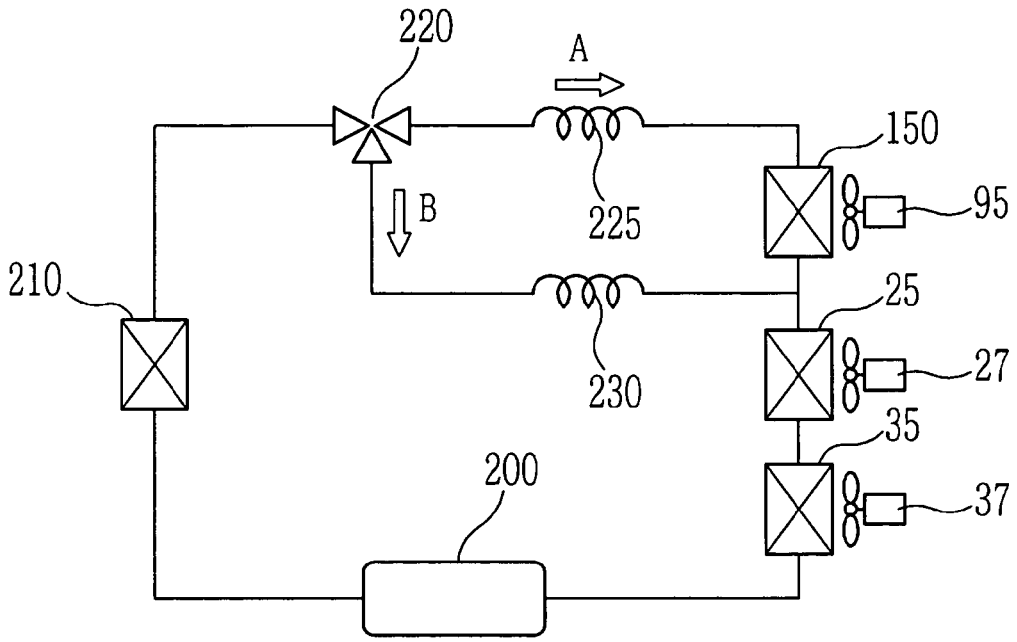
FIGS. 4A and 4B are views illustrating cycles in which a refrigerant pipe of the ice making chamber according to the embodiment of the present invention and evaporators in the refrigerator are connected in series.
Figure 4B:
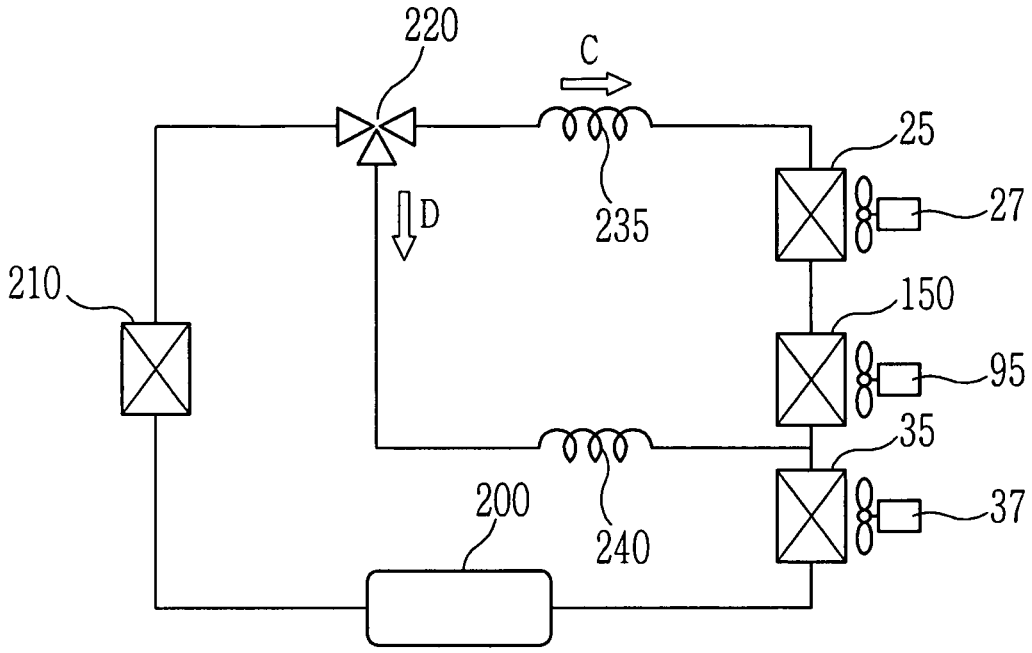
Figure 4C:
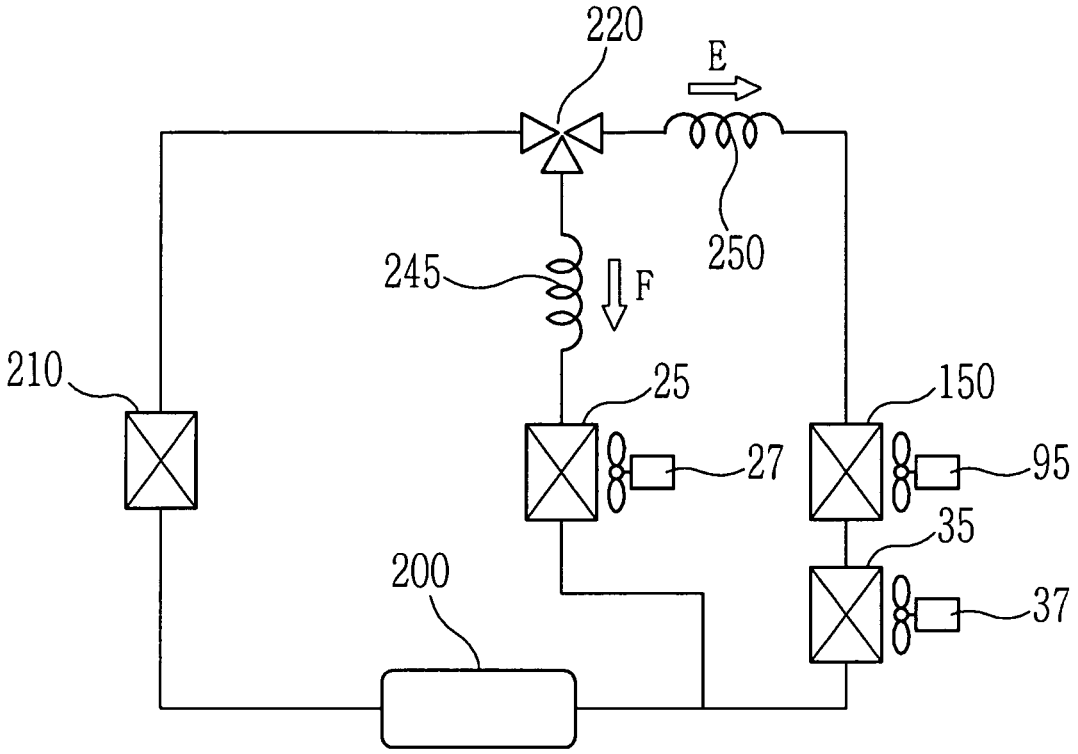
FIG. 4C is a view illustrating a cycle in which the refrigerant pipe of the ice making chamber according to the embodiment of the present invention and the evaporators in the refrigerator are connected in parallel.

FIGS. 4A and 4B are views illustrating cycles in which the refrigerant pipe of the ice making chamber according to the embodiment and the evaporators in the refrigerator are connected in series, and FIG. 4C is a view illustrating a cycle in which the refrigerant pipe of the ice making chamber according to the embodiment and the evaporators in the refrigerator are connected in parallel.

A series type refrigeration cycle will be described with reference to FIG. 4A. A compressor 200 and a condenser 210 are disposed at the rear of the refrigerator body 10. An incombustible refrigerant discharged from the compressor 200 passes through the condenser 210, and the flow of the refrigerant is changed by a three-way valve 220. A first capillary tube 225, the ice making chamber refrigerant pipe 150, the refrigerating chamber evaporator 25 and the freezing chamber evaporator 35 are successively connected to one outlet of the three-way valve 220. A second capillary tube 230, the refrigerating chamber evaporator 25 and the freezing chamber evaporator 35 are successively connected to the other outlet of the three-way valve 220.

In a state in which the ice storage container 60 of the ice making chamber 90 is not full of ice, the refrigerant flows in an 'A' direction, and the refrigerant decompressed by the first capillary tube 225 returns to the compressor 200 via the ice making chamber refrigerant pipe 150, the refrigerating chamber evaporator 25 and the freezing chamber evaporator 35 in order.

In a state in which the ice storage container 60 of the ice making chamber 90 is full of ice and temperature of the ice making chamber 90 is less than a predetermined temperature, the refrigerant flows in a 'B' direction, and the refrigerant decompressed by the second capillary tube 230 returns to the compressor 200 via the refrigerating chamber evaporator 25 and the freezing chamber evaporator 35 in order.

In a state in which the ice storage container 60 of the ice making chamber 90 is full of ice and temperature of the ice making chamber 90 is not less than the predetermined temperature, the refrigerant flows in the 'A' direction since the ice of the ice making chamber 90 may melt.

Meanwhile, air is circulated in the refrigerating chamber 20 and the freezing chamber 30 by the refrigerating chamber circulation fan 27 and the freezing chamber circulation fan 37, respectively. Also, air is circulated in the ice making chamber 90 by the ice making chamber circulation fan 95. At this time, the refrigerating chamber circulation fan 27, the freezing chamber circulation fan 37 and the ice making chamber circulation fan 95 are controlled to be turned on/off according to interior temperature of the refrigerating chamber 20, the freezing chamber 30 and the ice making chamber 90.

In the above series type refrigeration cycle, frost may be formed at the bottom of the drain duct 170 when the flow of the refrigerant is changed from the A direction to the B direction for the following reasons.

In the state in which the ice storage container 60 of the ice making chamber 90 is full of ice and the temperature of the ice making chamber 90 is less than the predetermined temperature, the flow of the refrigerant is changed from the A direction to the B direction, and the ice making chamber circulation fan 95 is turned off. In a state in which the ice making chamber circulation fan 95 is turned off, air circulation is not sufficiently achieved, with the result that the temperature of the air in the ice making chamber 90 gradually increases. However, cool air from the refrigerant remaining in the ice making chamber refrigerant pipe 150 is transmitted to the drain duct 170, with the result that a rising speed in temperature of the drain duct 170 becomes lower than that of the air in the ice making chamber 90. Consequently, temperature at the bottom of the drain duct 170 becomes lower than that of ambient air and finally reaches the dew point, with the result that frost is formed at the bottom of the drain duct 170.

Another series type refrigeration cycle will be described with reference to FIG. 4B. A refrigerant discharged from the compressor 200 passes through the condenser 210, and the flow of the refrigerant is changed by the three-way valve 220. A third capillary tube 235, the refrigerating chamber evaporator 25, the ice making chamber refrigerant pipe 150, and the freezing chamber evaporator 35 are successively connected to one outlet of the three-way valve 220. A fourth capillary tube 240 and the freezing chamber evaporator 35 are successively connected to the other outlet of the three-way valve 220.

In a state in which the ice storage container 60 of the ice making chamber 90 is not full of ice, the refrigerant flows in a 'C' direction, and the refrigerant decompressed by the third capillary tube 235 returns to the compressor 200 via the refrigerating chamber evaporator 25, the ice making chamber refrigerant pipe 150 and the freezing chamber evaporator 35 in order.

In a state in which the ice storage container 60 of the ice making chamber 90 is full of ice and temperature of the ice making chamber 90 is not less than the predetermined temperature, the refrigerant flows in the 'C' direction since the ice of the ice making chamber 90 may melt.

In a state in which the ice storage container 60 of the ice making chamber 90 is full of ice, temperature of the ice making chamber 90 is less than the predetermined temperature, and temperature of the refrigerating chamber 20 is higher than a refrigerating temperature band, the refrigerant flows in the 'C' direction to lower the temperature of the refrigerating chamber 20.

In a state in which the ice storage container 60 of the ice making chamber 90 is full of ice, temperature of the ice making chamber 90 is less than the predetermined temperature, and temperature of the refrigerating chamber 20 is lower than the refrigerating temperature band, the refrigerant flows in a 'D' direction.

In the above series type refrigeration cycle, frost may be formed at the bottom of the drain duct 170 when the flow of the refrigerant is changed from the C direction to the D direction and when the ice making chamber circulation fan 95 is turned off during circulation of the refrigerant in the C direction for the following reasons.

First, when the flow of the refrigerant is changed from the C direction to the D direction, frost is formed at the bottom of the drain duct 170 for the same reason as when the flow of the refrigerant is changed from the A direction to the B direction as described with reference to FIG. 4A. That is, cool air from the refrigerant remaining in the ice making chamber refrigerant pipe 150 is transmitted to the drain duct 170, with the result that a rising speed in temperature of the drain duct 170 becomes lower than that of the air in the ice making chamber 90. Consequently, temperature at the bottom of the drain duct 170 reaches the dew point, with the result that frost is formed at the bottom of the drain duct 170.

Second, when the ice making chamber circulation fan 95 is turned off during circulation of the refrigerant in the C direction, temperature difference between the bottom of the drain duct 170 and air contacting the bottom of the drain duct 170 is gradually increased. Consequently, temperature at the bottom of the drain duct 170 reaches the dew point, with the result that frost is formed at the bottom of the drain duct 170. For example, when the temperature of air in the ice making chamber 90 is less than the predetermined temperature, and the temperature of the refrigerating chamber 20 has not reached the refrigerating temperature band, the refrigerant flows in the 'C' direction to lower the temperature of the refrigerating chamber 20 to the refrigerating temperature band, but the ice making chamber circulation fan 95 is turned off. Consequently, the temperature at the bottom of the drain duct 170 reaches the dew point for the above-stated reason, with the result that frost is formed at the bottom of the drain duct 170.

A parallel type refrigeration cycle will be described with reference to FIG. 4C. An incombustible refrigerant discharged from the compressor 200 passes through the condenser 210, and the flow of the refrigerant is changed by the three-way valve 220. A fifth capillary tube 245 and the refrigerating chamber evaporator 25 are successively connected to one outlet of the three-way valve 220. A sixth capillary tube 250, the ice making chamber refrigerant pipe 150 and the freezing chamber evaporator 35 are successively connected to the other outlet of the three-way valve 220.

In a state in which the ice storage container 60 of the ice making chamber 90 is not full of ice, the refrigerant flows in an 'E' direction, and the refrigerant decompressed by the sixth capillary tube 250 returns to the compressor 200 via the ice making chamber refrigerant pipe 150 and the freezing chamber evaporator 35 in order.

In a state in which the ice storage container 60 of the ice making chamber 90 is full of ice and the temperature of the ice making chamber 90 is not less than the predetermined temperature, the refrigerant flows in the 'E' direction to prevent ice made and stored in the ice making chamber 90 from melting.

In a state in which the ice storage container 60 of the ice making chamber 90 is full of ice, temperature of the ice making chamber 90 is less than the predetermined temperature, and temperature of the freezing chamber 30 has not reached a freezing temperature band, the refrigerant flows in the 'E' direction to cool the freezing chamber 30.

In a state in which the ice storage container 60 of the ice making chamber 90 is full of ice, temperature of the ice making chamber 90 is less than the predetermined temperature, and temperature of the freezing chamber 30 has reached reach the freezing temperature band, the refrigerant flows in an 'F' direction, and the refrigerant decompressed by the fifth capillary tube 245 returns to the compressor 200 via the refrigerating chamber evaporator 25.

In the above parallel type refrigeration cycle, frost may be formed at the bottom of the drain duct 170 of the ice making unit 100 for two reasons similar to those of the series type refrigeration cycle shown in FIG. 4B.

First, when the flow of the refrigerant is changed from the E direction to the F direction, frost is formed at the bottom of the drain duct 170 for the same reason as when the flow of the refrigerant is changed from the C direction to the D direction as described with reference to FIG. 4B. That is, cool air from the refrigerant remaining in the ice making chamber refrigerant pipe 150 is transmitted to the drain duct 170, with the result that a rising speed in temperature of the drain duct 170 becomes lower than that of the air in the ice making chamber 90. Consequently, temperature at the bottom of the drain duct 170 reaches the dew point, with the result that frost is formed at the bottom of the drain duct 170.

Second, in a state in which the refrigerant flows in the ice making chamber refrigerant pipe 150 but the ice making chamber circulation fan 95 is off, frost may be formed at the bottom of the drain duct 170. For example, when temperature of the air in the ice making chamber 90 is less than the predetermined temperature, and temperature of the freezing chamber 30 has not reached the freezing temperature band, the refrigerant flows in the 'E' direction to lower the temperature of the freezing chamber 30 to the freezing temperature band but the ice making chamber circulation fan 95 is turned off. Consequently, the temperature at the bottom of the drain duct 170 reaches the dew point for the above-stated reason, with the result that frost is formed at the bottom of the drain duct 170.

Embodiments are not limited to the above-described series and parallel type refrigeration cycles. Other series or parallel refrigeration cycles or other different types of refrigeration cycle may be adopted.

Figure 5:
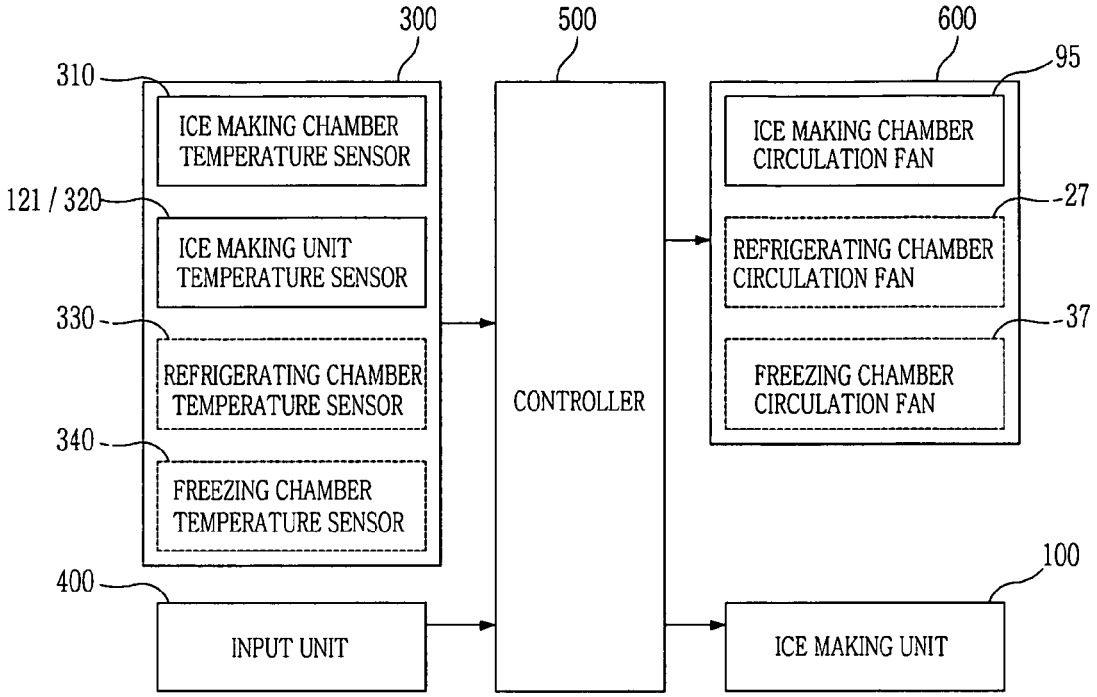
FIG. 5 is a control block diagram of a refrigerator according to an embodiment.

FIG. 5 is a control block diagram of a refrigerator according to an embodiment.

As shown in FIG. 5, the refrigerator includes an ice making unit 100 to make ice from water supplied through a water supply pipe (not shown), a temperature detection unit 300 including an ice making chamber temperature sensor 310 mounted at one inner side of the ice making chamber 90 to measure temperature of air, an ice making unit temperature sensor 121 mounted at the ice making unit 100 to measure temperature of ice and an ice making tray 120, another ice making unit temperature sensor 320 mounted at the ice making unit 100 to measure temperature of a drain duct 170, a refrigerating chamber temperature sensor 330 to measure temperature of a refrigerating chamber 20, and a freezing chamber temperature sensor 340 to measure temperature of a freezing chamber 30, an input unit 400 to allow a user to set an ice making mode or a non-ice making mode of the refrigerator, and a fan unit 600 including an ice making chamber circulation fan 95, a refrigerating chamber circulation fan 27 and a freezing chamber circulation fan 37 to create a forced air stream and to circulate cool air in the ice making chamber 90, the refrigerating chamber 20 and the freezing chamber 30, respectively.

When the user sets an ice making mode (ICE-ON) through the input unit 400, a controller 500 determines whether an ice storage container 60 of the ice making chamber 90 is full of ice. Upon determining that the ice storage container 60 of the ice making chamber 90 is not full of ice, the controller 500 supplies water to the ice making unit 100 through the water supply pipe (not shown), and supplies a refrigerant to an ice making chamber refrigerant pipe 150 such that the water supplied to the ice making unit 100 changes into ice.

The controller 500 controls the ice making chamber circulation fan 95 to be turned on/off according to interior temperature of the ice making chamber 90 received from the ice making chamber temperature sensor 310. When the interior temperature of the ice making chamber 90 is less than a predetermined temperature, the controller 500 controls the ice making chamber circulation fan 95 to be turned off. When the interior temperature of the ice making chamber 90 is not less than the predetermined temperature, the controller 500 controls the ice making chamber circulation fan 95 to be turned on to create a forced air stream in the ice making chamber 90 such that cool air is circulated in the ice making chamber 90.

In the series type refrigeration cycle of FIG. 4A, upon determining that the ice storage container 60 of the ice making chamber 90 is full of ice and the interior temperature of the ice making chamber 90 is less than the predetermined temperature, the controller 500 controls the three-way valve 220 to interrupt the flow of the refrigerant in the ice making chamber refrigerant pipe 150. At this time, the controller 500 controls the ice making chamber circulation fan 95 to be driven for a predetermined period of time from the moment when the flow of the refrigerant in the ice making chamber refrigerant pipe 150 is interrupted or until temperature of the ice making tray 120 or the drain duct 170 is equal to that of the air in the ice making chamber 90 to create a forced air stream such that there is no temperature difference between the bottom of the drain duct 170 and the air in the ice making chamber 90. On the other hand, when the temperature at the bottom of the drain duct 170 is equal to that of the air in the ice making chamber 90, the temperature at the bottom of the drain duct 170 does not reach the dew point, thereby preventing frost formation.

In the series type refrigeration cycle of FIG. 4B, upon determining that the ice storage container 60 of the ice making chamber 90 is full of ice, the interior temperature of the ice making chamber 90 is less than the predetermined temperature, and the temperature of the refrigerating chamber 20 is lower than the refrigerating temperature band, the controller 500 controls the three-way valve 220 to interrupt the flow of the refrigerant in the ice making chamber refrigerant pipe 150. At this time, the controller 500 controls the ice making chamber circulation fan 95 to be driven for a predetermined period of time from the moment when the flow of the refrigerant in the ice making chamber refrigerant pipe 150 is interrupted or until the temperature of the ice making tray 120 or the drain duct 170 is equal to that of the air in the ice making chamber 90 to prevent frost formation. Also, when the temperature of the ice making chamber 90 falls below the predetermined temperature during circulation of the refrigerant in the C direction with the result that the ice making chamber circulation fan 95 is turned off, the controller 500 controls the ice making chamber circulation fan 95 to be re-driven for a predetermined period of time from the moment when the ice making chamber circulation fan 95 is turned off or until temperature of the ice making tray 120 or the drain duct 170 is equal to that of the air in the ice making chamber 90 to prevent frost formation.

In the parallel type refrigeration cycle of FIG. 4C, upon determining that the ice storage container 60 of the ice making chamber 90 is full of ice, the interior temperature of the ice making chamber 90 is less than the predetermined temperature, and the temperature of the freezing chamber 30 is lower than the freezing temperature band, the controller 500 controls the three-way valve 220 to interrupt the flow of the refrigerant in the ice making chamber refrigerant pipe 150. At this time, the controller 500 controls the ice making chamber circulation fan 95 to be driven for a predetermined period of time from the moment when the flow of the refrigerant in the ice making chamber refrigerant pipe 150 is interrupted or until the temperature of the ice making tray 120 or the drain duct 170 is equal to that of the air in the ice making chamber 90 to prevent frost formation. Also, when the temperature of the ice making chamber 90 falls below the predetermined temperature during circulation of the refrigerant in the E direction with the result that the ice making chamber circulation fan 95 is turned off, the controller 500 controls the ice making chamber circulation fan 95 to be re-driven for a predetermined period of time from the moment when the ice making chamber circulation fan 95 is turned off or until the temperature of the ice making tray 120 or the drain duct 170 is equal to that of the air in the ice making chamber 90 to prevent frost formation.

As described above, upon driving the ice making chamber circulation fan 95, the controller 500 controls drive speed of the ice making chamber circulation fan 95 to prevent frost from being formed in the ice making chamber 90. When the ice making chamber circulation fan 95 is driven to prevent frost formation while the supply of the refrigerant to the ice making chamber 90 is interrupted, the controller 500 sets the drive speed of the ice making chamber circulation fan 95 to a high mode (for example, 2900 RPM) such that the temperature at the bottom of the drain duct 170 becomes equal to that of the air in the ice making chamber 90 as rapidly as possible. Also, when the ice making chamber circulation fan 95 is driven to prevent frost formation while the refrigerant is supplied to the ice making chamber 90, the controller 500 sets the drive speed of the ice making chamber circulation fan 95 to a low mode (for example, 2300 RPM) such that the temperature at the bottom of the drain duct 170 becomes equal to that of the air in the ice making chamber 90 while saving energy. This is because the refrigerant is continuously supplied to the ice making chamber 90, and therefore, forced air stream may be created in the ice making chamber 90 for a relatively long time unlike the above case.

The controller 500 may calculate temperature difference between the air in the ice making chamber 90 and the drain duct 170 or the ice making tray 120 according to temperature information received from the ice making chamber temperature sensor 310 and the ice making unit temperature sensors 121 and 320 to decide drive time of the ice making chamber circulation fan 95 to prevent frost formation.

Hereinafter, a method of preventing frost from being formed in the ice making chamber 90 in an arbitrary type refrigeration cycle will be described in detail.

Figure 6A:
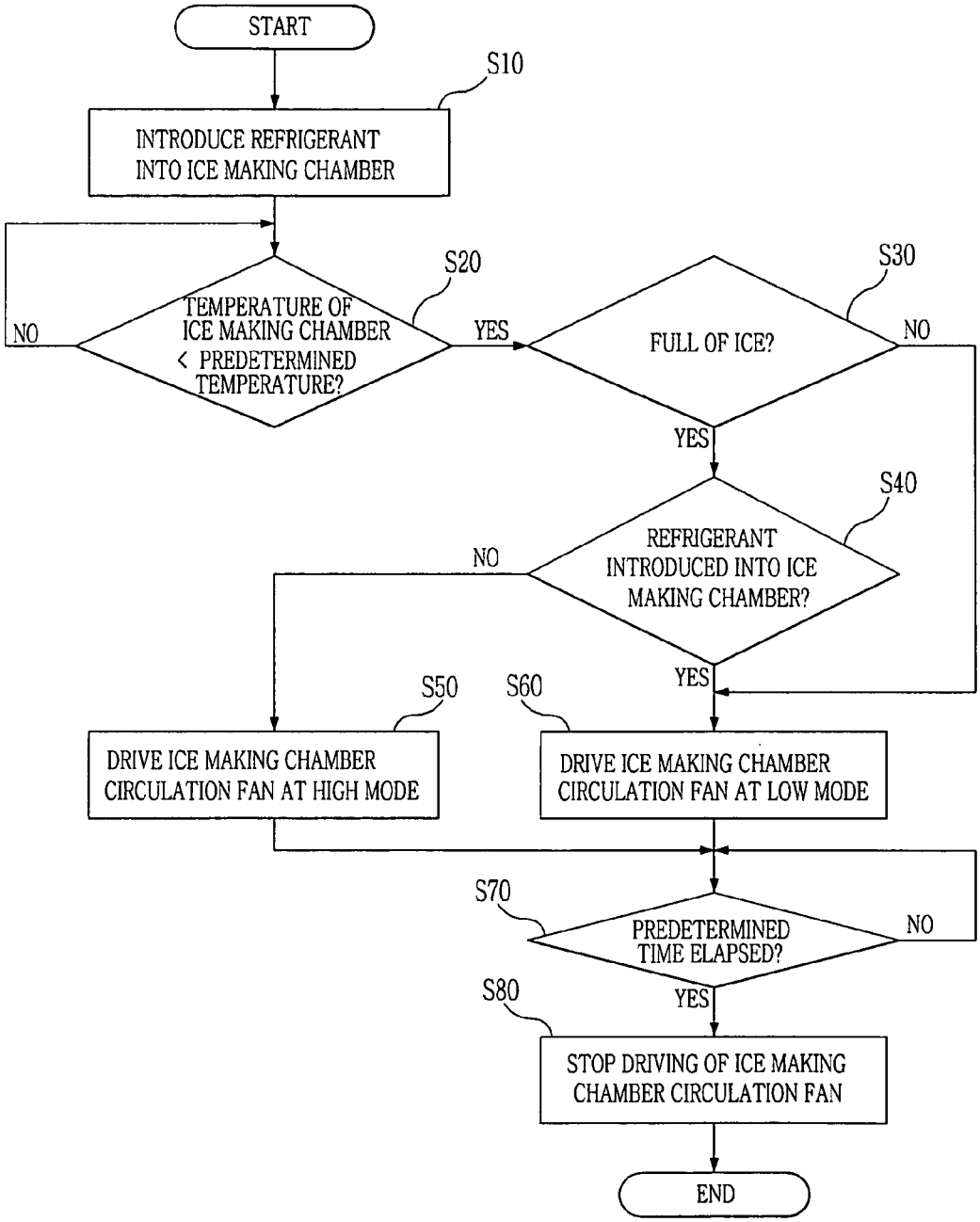
FIG. 6A is a control flow chart of the refrigerator to prevent frost from being formed in the ice making chamber according to the embodiment.

FIG. 6A is a control flow chart of the refrigerator to prevent frost from being formed in the ice making chamber according to the embodiment of the present invention.

As shown in FIG. 6A, when a refrigerant is introduced into the ice making chamber 90 to make ice or according to a refrigeration cycle, the controller 500 compares temperature of air in the ice making chamber 90 with a predetermined temperature to perform a control operation to prevent frost from being formed in the ice making chamber 90 (510 and S20).

Subsequently, upon determining that the temperature of the air in the ice making chamber 90 is lower than the predetermined temperature, the controller 500 determines whether the ice making chamber 90 is full of ice (S30).

Subsequently, upon determining that the ice making chamber 90 is full of ice, the controller 500 determines whether the refrigerant is continuously introduced into the ice making chamber 90. Referring to FIGS. 4B and 4C, when the temperature of the refrigerating chamber 20 is higher than the refrigerating temperature band or the temperature of the freezing chamber 30 is higher than the freezing temperature band although the temperature of the ice making chamber 90 is lower than the predetermined temperature and the ice making chamber 90 is full of ice, the refrigerant is continuously introduced into the ice making chamber 90 (S40).

Subsequently, upon determining that the refrigerant is continuously introduced into the ice making chamber 90, the controller 500 controls the ice making chamber circulation fan 95 to be driven at the low mode (for example, 2300 RPM) to prevent frost from being formed in the ice making chamber 90 while saving energy (S60).

Also, upon determining at Operation S30 that the ice making chamber 90 is not full of ice, which means that the refrigerant is introduced into the ice making chamber 90 while the driving of the ice making chamber circulation fan 95 is stopped, the controller 500 controls the ice making chamber circulation fan 95 to be driven at the low mode to prevent frost formation (S60).

On the other hand, upon determining at Operation S40 that the refrigerant is not continuously introduced into the ice making chamber 90, the controller 500 controls the ice making chamber circulation fan 95 to be driven at the high mode (for example, 2700 RPM) such that the temperature of the drain duct 170 or the ice making tray 120 becomes equal to the interior temperature of the ice making chamber 90 within a short period of time (S50).

Subsequently, the controller 500 determines whether a predetermined time has elapsed after driving the ice making chamber circulation fan 95 to prevent frost from being formed in the ice making chamber 90 (S70). Upon determining that the predetermined time has elapsed, the controller 500 controls the driving of the ice making chamber circulation fan 95 to be stopped (S80). Meanwhile, the drive time of the ice making chamber circulation fan may be differently set when the ice making chamber circulation fan is driven at the high mode and at the low mode.

Figure 6B:
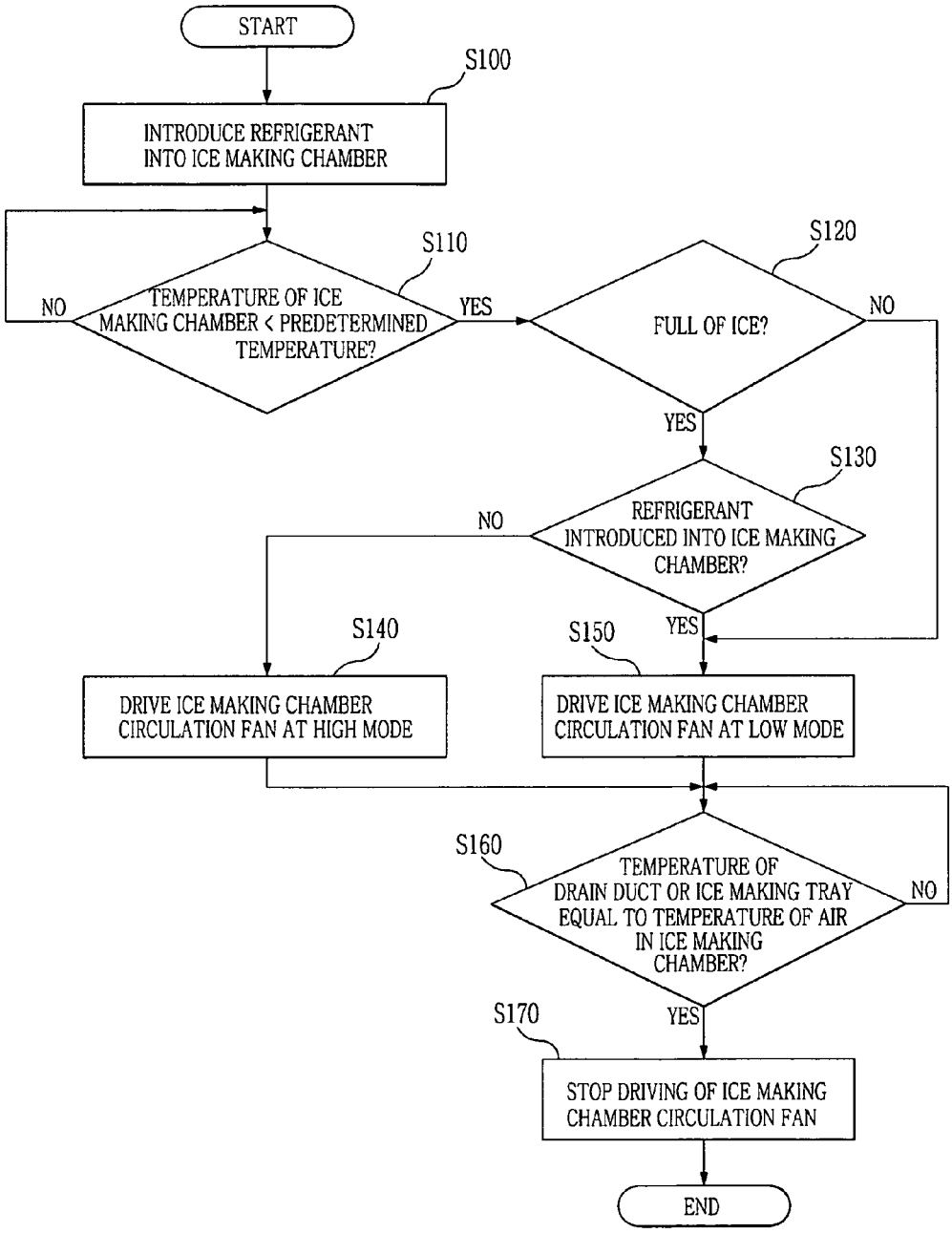
FIG. 6B is a control flow chart of the refrigerator to prevent frost from being formed in the ice making chamber according to the embodiment.

FIG. 6B is a control flow chart of the refrigerator to prevent frost from being formed in the ice making chamber according to the embodiment of the present invention. Operations S100 to S150 of FIG. 6B are the same as Operations 810 to S60 of FIG. 6A, and therefore, a description thereof will not be given.

After driving the ice making chamber circulation fan 95 at the high or low mode at Operation S140 or S150, the controller 500 compares temperature of the drain duct 170 or the ice making tray 120 measured by the ice making unit temperature sensor 121 with temperature of air in the ice making chamber 90 measured by the ice making chamber temperature sensor 310 (S160). Upon determining that the temperature of the drain duct 170 or the ice making tray 120 is equal to the temperature of air in the ice making chamber 90, the controller controls the driving of the ice making chamber circulation fan 95 to be stopped (S170).

The above control operation is periodically performed to prevent frost from being formed in the ice making chamber 90.

As is apparent from the above description, the temperature difference between the drain duct of the ice making unit and the air in the ice making chamber is eliminated, thereby preventing frost from being formed at the drain duct.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A control method of a refrigerator comprising an ice making chamber having an ice making tray, an ice making chamber refrigerant pipe to supply cool air to the ice making tray, an ice making chamber circulation fan to circulate air in the ice making chamber, and an ice storage container, the control method comprising:

sensing a temperature of the ice making chamber;

determining whether the temperature of the ice making chamber is lower than a predetermined temperature;

determining whether the ice storage container is full of ice; and driving the ice making chamber circulation fan to prevent frost from being formed in the ice making chamber when the temperature of the ice making chamber is lower than the predetermined temperature and the ice storage container is full of ice by measuring a temperature of the ice making tray; and by driving the ice making chamber circulation fan until the temperature of the ice making tray is equal to the temperature of the ice making chamber.

2. The control method according to claim 1, further comprising:

determining whether a refrigerant flows in the ice making chamber refrigerant pipe, wherein the driving of the ice making chamber circulation fan to prevent frost from being formed in the ice making chamber further comprises:

variably driving the ice making chamber circulation fan based on whether the refrigerant flows in the ice making chamber refrigerant pipe.

3. The control method according to claim 2, wherein the ice making chamber circulation fan, when flow of a refrigerant is absent in the ice making chamber refrigerant pipe, has an ice making chamber circulation fan speed lower than an ice making chamber circulation fan speed corresponding to when flow of a refrigerant is present in the ice making chamber refrigerant pipe.

4. The control method according to claim 3, wherein the ice making chamber circulation fan is driven at about 2300 RPM, when flow of a refrigerant is absent in the ice making chamber refrigerant pipe, and wherein the ice making chamber circulation fan is driven at about 2900 RPM, when flow of a refrigerant is present in the ice making chamber refrigerant pipe.

5. The control method according to claim 2, wherein the ice making chamber circulation fan is driven for different periods of drive times based on whether a refrigerant flows in the ice making chamber refrigerant pipe.

6. The control method according to claim 2, wherein the ice making chamber circulation fan, when flow of a refrigerant is present in the ice making chamber refrigerant pipe, has an energy expenditure smaller than an energy expenditure corresponding to when flow of a refrigerant is absent in the ice making chamber refrigerant pipe.

7. The control method according to claim 1, further comprising driving the ice making chamber circulation fan at a first mode in a state in which the temperature of the ice making chamber is lower than the predetermined temperature and the refrigerant flows in the ice making chamber refrigerant pipe.

8. The control method according to claim 1, further comprising driving the ice making chamber circulation fan at a second mode when flow of the refrigerant in the ice making chamber refrigerant pipe is interrupted in a state in which the temperature of the ice making chamber is lower than the predetermined temperature.

9. The control method according to claim 1, further comprising driving the ice making chamber circulation fan at a first mode in a state in which the temperature of the ice making chamber is lower than the predetermined temperature and the ice storage container is not full of ice.

10. A control method of a refrigerator comprising an ice making chamber, an ice making unit disposed in the ice making chamber, and an ice making chamber circulation fan to circulate cool air in the ice making chamber, the control method comprising:

measuring a temperature of the ice making chamber;

determining whether the temperature of the ice making chamber is lower than a predetermined temperature;

determining whether the temperature of the ice making chamber is equal to a temperature of the ice making unit when the temperature of the ice making chamber is lower than the predetermined temperature; and stopping the ice making chamber circulation fan, when being driven, upon determining that the temperature of the ice making chamber is equal to the temperature of the ice making unit.

11. The control method according to claim 10, wherein the ice making unit comprises an ice making tray, and detecting the temperature of the ice making unit comprises detecting a temperature of the ice making tray.

12. The control method according to claim 11, wherein the ice making unit further comprises a drain duct provided below the ice making tray, and detecting the temperature of the ice making unit comprises detecting a temperature of the drain duct.

13. A control method of a refrigerator comprising an ice making chamber haying an ice making tray, an ice making chamber refrigerant pipe to supply cool air to the ice making tray, an ice making chamber circulation fan to circulate air in the ice making chamber, a drain duct of an inclined structure disposed below the ice making tray, and an ice storage container, the control method comprising:

sensing a temperature of the ice making chamber;

determining whether the temperature of the ice making chamber is lower than a predetermined temperature;

determining whether the ice storage container is full of ice; and driving the ice making chamber circulation fan to prevent frost from being formed in the ice making chamber when the temperature of the ice making chamber is lower than the predetermined temperature and the ice storage container is full of ice by measuring a temperature of the drain duct; and by driving the ice making chamber circulation fan until the temperature of the drain duct is equal to the temperature of the ice making chamber.

14. The control method according to claim 13, further comprising:

determining whether a refrigerant flows in the ice making chamber refrigerant pipe, wherein the driving of the ice making chamber circulation fan to prevent frost from being formed in the ice making chamber further comprises:

variably driving the ice making chamber circulation fan based on whether the refrigerant flows in the ice making chamber refrigerant pipe.

* * * * *